United States Patent [19]

Tourtelot, Jr.

[11] 4,205,634

[45] Jun. 3, 1980

[54] VARIABLE VALVE TIMING MECHANISM

[76] Inventor: Edward M. Tourtelot, Jr., 2719 N. Sheridan Rd., Evanston, Ill. 60201

[21] Appl. No.: 878,520

[22] Filed: Feb. 17, 1978

[51] Int. Cl.[2] ..... F01L 1/34; F16H 53/02

[52] U.S. Cl. ..... 123/90.15; 123/90.16; 123/90.17; 123/90.41; 123/90.6; 74/54; 74/55; 74/567

[58] Field of Search ..... 123/90.15, 90.16, 90.17, 123/90.6, 90.39, 90.41, 90.44, 90.45, 90.47; 74/567, 569, 54, 55

[56] References Cited

U.S. PATENT DOCUMENTS

| | | | |
|---|---|---|---|
| 1,165,135 | 12/1915 | Seitz | 123/90.6 |
| 1,388,863 | 8/1921 | Jepson | 123/90.16 |
| 1,930,261 | 10/1933 | Berry | 123/90.6 |
| 2,880,712 | 4/1959 | Roan | 123/90.16 |
| 2,934,052 | 4/1960 | Longenecker | 123/90.16 |
| 3,045,657 | 7/1962 | Sampietro | 123/90.6 |
| 3,911,879 | 10/1975 | Altmann | 123/90.16 |

FOREIGN PATENT DOCUMENTS

| | | | |
|---|---|---|---|
| 1109790 | 9/1955 | France | 123/90.17 |

*Primary Examiner*—Charles J. Myhre
*Assistant Examiner*—Jeffrey L. Yates
*Attorney, Agent, or Firm*—Merriam, Marshall & Bicknell

[57] ABSTRACT

Mechanism for varying the timing of the valves of an internal combustion engine to obtain optimum efficiency and performance of the engine throughout a substantial portion of its operating speed range, wherein cam means for at least each intake valve is mounted on a rotatable cam shaft of the engine. Each cam means includes at least one and preferably a pair of axially spaced first cam members contoured to provide a first timing for their associated valves such as to provide optimum performance throughout one operating speed range of the engine and a second cam member of smaller size than and positioned between the first cam members and contoured to provide optimum performance throughout another operating speed range. Timing of the valves is normally controlled by the first cam members acting through linkage connected to the valves, and a plurality of elongated finger followers are provided for coaction with the second cam members to render them effective to control the timing of the valves. The finger followers are shiftable to different positions of engagement with the second cam members so that the timing of the valves is controlled either only by the first cam members, or partially by both the first and second cam members, or only by the second cam members.

14 Claims, 13 Drawing Figures

VARIABLE VALVE TIMING MECHANISM

This invention relates generally to a mechanism for actuating the valves of an internal combustion engine, and more particularly relates to a mechanism for varying the timing of the valves of an internal combustion engine in order to obtain optimum efficiency of the engine throughout its operating speed range.

Because of the fact that internal combustion engines for automotive vehicles must operate under widely varying speed and load conditions, the timing of the intake and exhaust valves of such engines is chosen so as to provide a reasonable degree of efficiency and performance throughout the expected range of speeds and loads. Such timing, however, does not provide optimum efficiency and performance at any perticular range of operating speeds and loads. Accordingly, efforts have been made to improve the efficiency of automotive internal combustion engines, particularly those employing poppet-type intake and exhaust valves, by varying the timing of such valves in relation to the working cycles of their respective cylinders.

One of the arrangements heretofore advanced for improving the efficiency and reducing the fuel consumption of an automotive internal combustion engine utilized a wedge-shaped insert for each of the intake valves of the engine, the inserts being positioned between the ends of the valve stems and push rods for the respective valves and being laterally shiftable to different positions between the ends of the valve stems and push rods so as to change the effective length of the linkage between the valves and their associated cams. Thus, by varying the positions of the inserts, the lift of the intake valves and thus the amount of combustible mixture supplied to the cylinders, could likewise be varied. Such an arrangement is disclosed in the U.S. Neal Pat. No. 1,220,530.

Other arrangements have been heretofore developed for varying the timing of the valves of an internal combustion engine for different operating conditions, which utilized laterally shifable cam followers positioned between the tappets and cams associated with the valves in order to vary the timing thereof. In one such arrangement, the contour of the cam on which the follower rode varied axially so that the periods during which the valves remained open could be varied by laterally swinging the followers on the cams. Such an arrangement is disclosed in the U.S. Ryder Pat. No. 2,678,641.

A somewhat similar arrangement is disclosed in the U.S. Repko Pat. No. 2,823,655, except that in the Repko patent, the lift and time that the valves remained open was changed in response to lateral shifting of the followers on a shaft and rotation of the shaft, respectively.

Variable valve timing mechanisms have also been proposed wherein a pair of cams was utilized to actuate each of the intake and exhaust valves of the engine and wherein the contours of the cams of each pair, which are suited for different operating speeds of the engine, were selectively rendered operable by axially shifting a rocker shaft. Movement of the rocker shaft resulting in tilting of intermediate connecting members which caused one or the other or both of the cams for each valve to become effective. Such a mechanism is disclosed in the U.S. Beal Pat. No. 3,269,375.

A variable valve timing mechanism utilizing two cams for each intake and exhaust valve of an automotive internal combustion engine has also been developed wherein an arcuately-shaped cam follower was positioned between the cams for each valve for transmitting movement from one or the other of the cams to their associated intake and exhaust valves. The followers were provided with recesses at longitudinally spaced positions therealong to accommodate passage of the lobes of one or the other of the cams for the respective valves without transmitting movement to the valves. The followers were shiftable to permit selective operation of one or the other of the cams for each valve. Such a mechanism is disclosed in the U.S. Longenecker Pat. No. 2,934,052.

Control arrangements for varying the timing and lift of the valves of an internal combustion engine have also been advanced wherein a pair of parallel levers or followers were positioned between the cam and tappets for the intake and exhaust valves of the engine, the levers being shiftable in opposite directions and having lobes thereon which coacted with multi-lobed cams to change the timing of the valves, depending upon the positions of the levers relative to the cams. Such a control arrangement is disclosed in the U.S. Walker Pat. No. 2,260,983.

While the aforementioned mechanisms and devices have accomplished their desired objectives, in varying degrees, they have not proved entirely satisfactory for various reasons, such as complexity of construction and operation, lack of reliability in operation, and high cost.

Accordingly, it is a general object of the present invention to provide a novel and improved mechanism for varying the timing of the valves of an internal combustion engine, which is free of the aforementioned disadvantages and objections.

A more particular object is to provide a novel mechanism for varying the timing of the intake and exhaust valves of an automotive internal combustion engine which improves the efficiency and performance of the engine throughout portions of its entire operating speed range and which reduces undesirable emissions from the engine.

A specific object is to provide a novel variable valve timing mechanism of the foregoing character, in which a conjugate cam having at least two different sized and contoured cam lobes is employed to actuate each valve of the engine and in which an elongated finger follower is shiftable between positions wherein the timing of the valve is controlled either entirely by one or the other of the lobes or partially by each of the lobes.

Still another object is to provide a novel variable valve timing mechanism of the foregoing character, in which the conjugate cam for actuating each valve of the engine has three, axially spaced, radial cam lobes, the outer lobes being larger than the central lobe, and in which the elongated finger follower of the mechanism is positioned between the outer lobes.

A further object is to provide a novel variable valve timing mechanism of the character described, which is simple in construction, reliable in operation and economical to manufacture.

These and other objects will become apparent from the following detailed description and accompanying sheets of drawings, in which.

Figure 13:
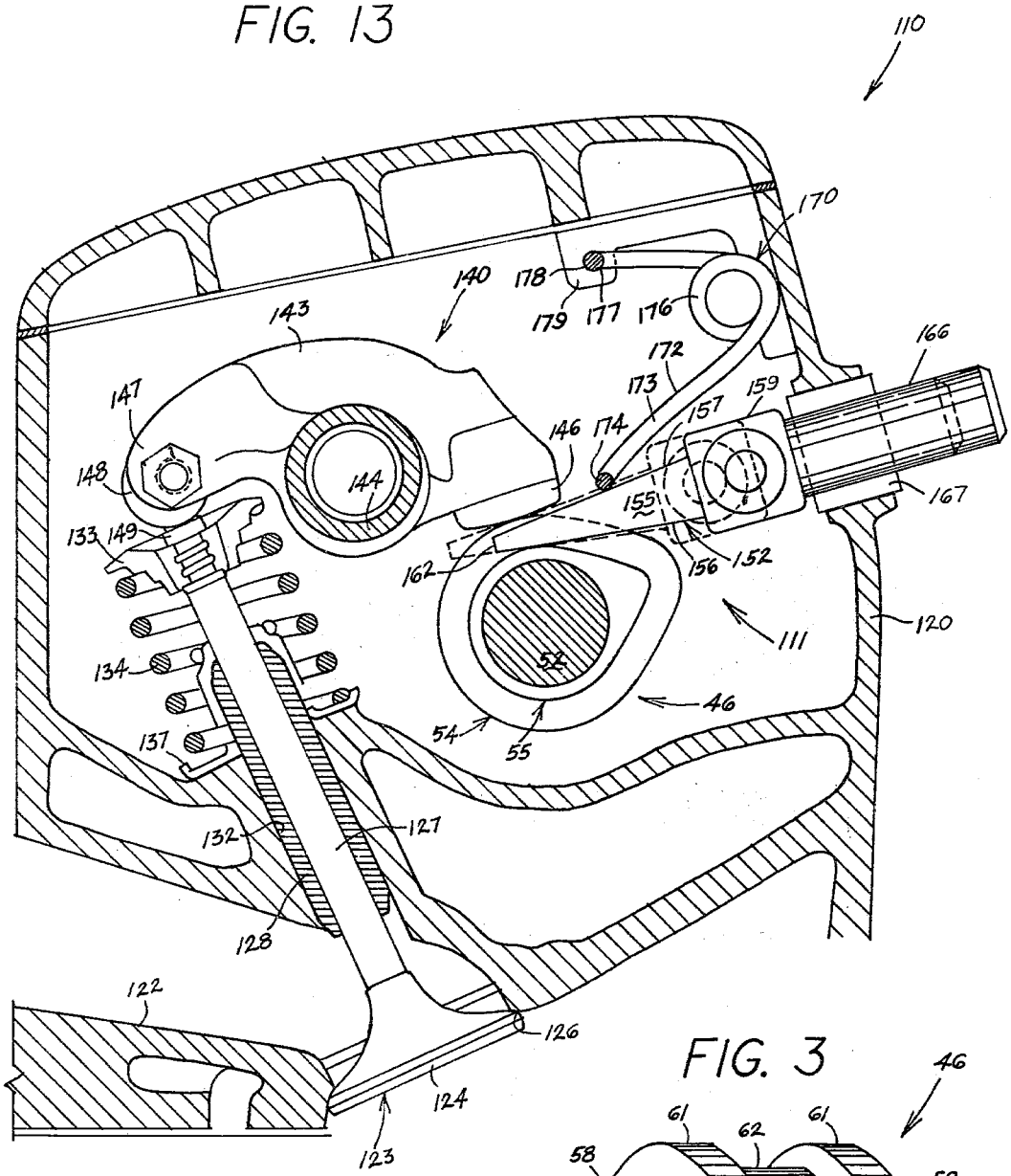
Figure 5:
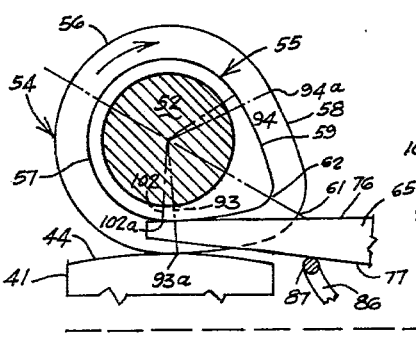
Figure 6:
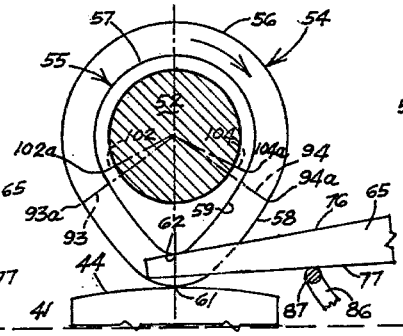
Figure 7:
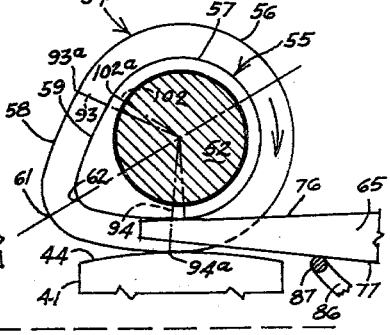
Figure 9:
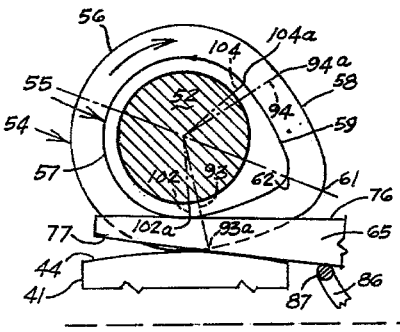
Figure 10:
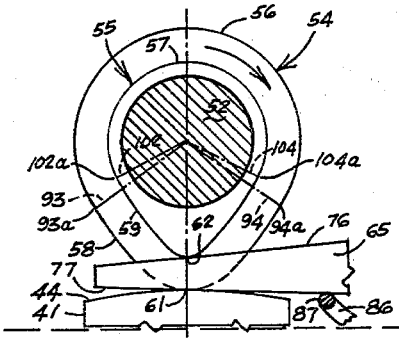
Figure 11:
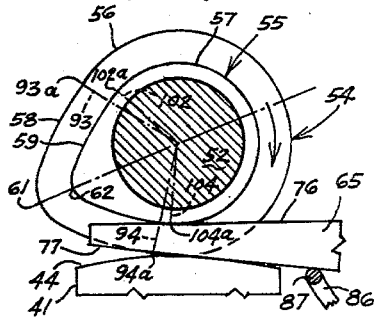
Figure 8:
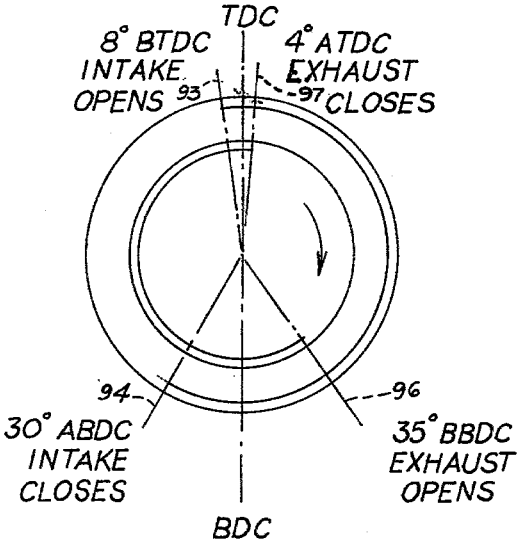
Figure 12:
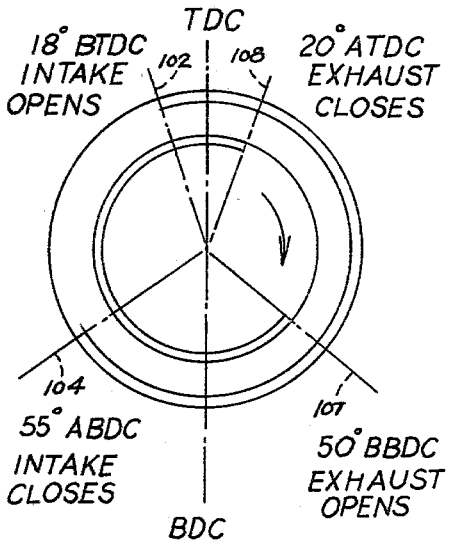

FIGS. 5-7, inclusive, are a series of diagrammatic longitudinal sectional views of a portion of the conjugate cam and finger follower and tappet end of the variable valve timing mechanism of the present invention and showing the positions of the parts thereof when the two outer lobes of the conjugate cam are functioning to control the timing of the associated valve and the finger follower of the mechanism is inoperative;

FIG. 8 is a diagram showing the timing of the intake and exhaust valves for one of the cylinders of the engine for the mode of operation of the mechanism illustrated in FIGS. 5-7, inclusive;

FIGS. 9-11, inclusive, are a series of diagrammatic views, similar to FIGS. 5-7, inclusive, of the conjugate cam and finger follower and tappet end of the variable valve timing mechanism of the present invention and showing the positions of the parts thereof when the finger follower is engaged with the central lobe of the conjugate cam and valve tappet so that the timing of the associated valve is controlled by the contour of the central lobe of the cam;

FIG. 12 is a diagram showing the timing of the intake and exhaust valves for one of the cylinders of the engine for the mode of operation of the mechanism illustrated in FIGS. 9-12, inclusive, when the finger follower is functioning; and FIG. 13 is a longitudinal sectional view, with some parts in elevation, of a portion of the cylinder head, valve cover and one of the valves of another overhead cam internal combustion engine incorporating a variable valve timing mechanism embodying the features of the present invention.

Figure 1:
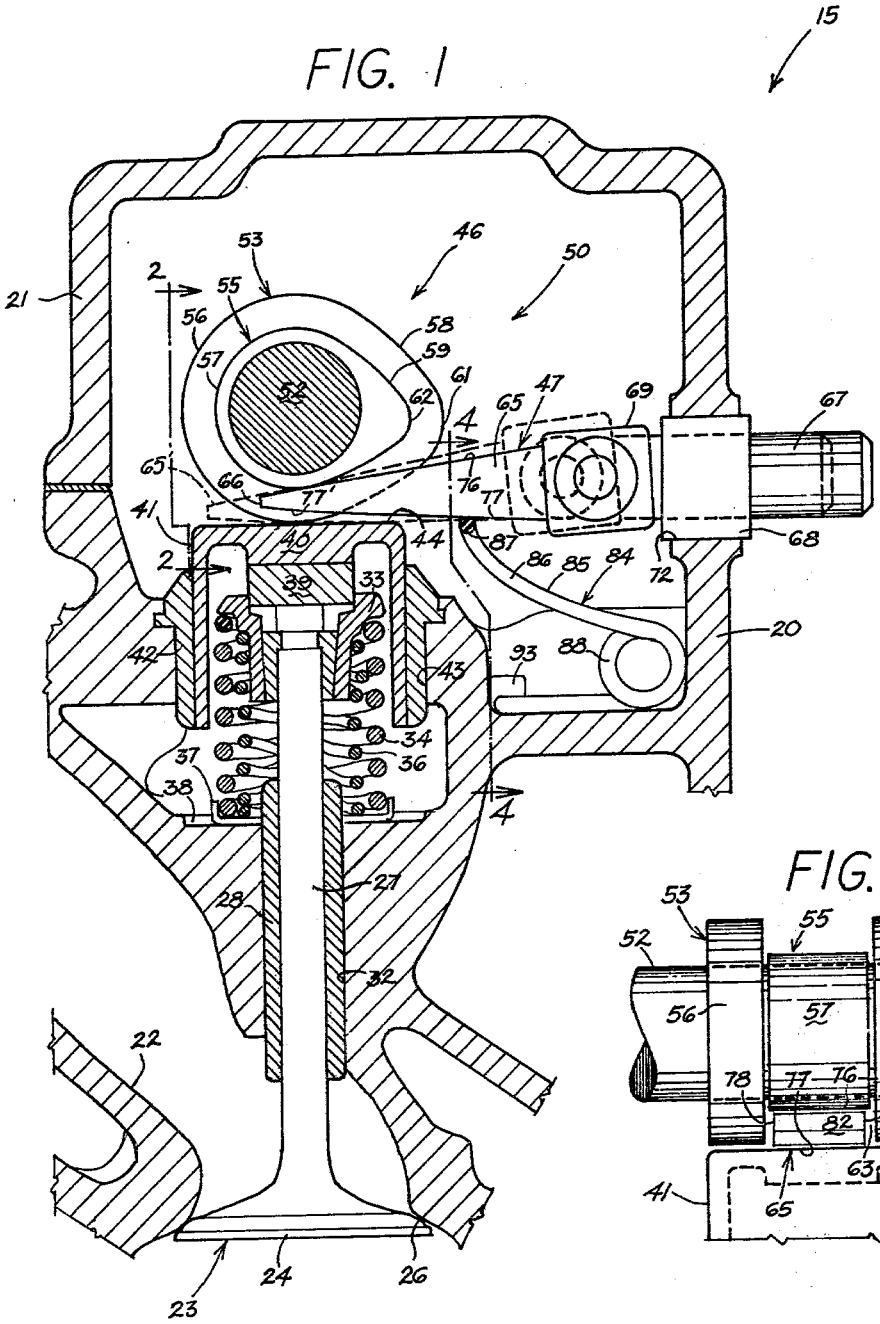
FIG. 1 is a vertical sectional view, with some parts in elevation, of a portion of the cylinder head, valve cover and one of the valves of an overhead camshaft internal combustion engine, the latter incorporating a mechanism embodying the features of the present invention for varying the timing of the valve.

In FIG. 1, a portion of a multi-cylinder, internal combustion engine is illustrated and indicated generally at 15. The engine 15, in the present instance, is adapted for use in an automotive application and includes a cylinder block (not shown) having a plurality of cylinders (also not shown) therein and a plurality of pistons (likewise not shown) reciprocably mounted in the cylinders. A portion of the cylinder head of the engine 15 is illustrated in FIG. 1 and indicated at 20, and the valve cover for the cylinder head 20 is indicated at 21.

The cylinder head 20, in the present instance, includes at least one intake and one exhaust passage for each cylinder, and at least one intake and one exhaust valve for controlling fluid flow through the intake and exhaust passages. For purposes of simplifying the description of the present invention, only one intake passage, indicated at 22, and one intake valve, indicated at 23, are shown in FIG. 1.

The valve 23 includes a head 24, which engages a seat 26 at the inner end of the passage 23, and an elongated stem 27. The stem 27 is shiftably mounted in a guide 28, which is mounted in a bore 32 in the cylinder head 20. A retainer 33 is secured to the upper end of the valve stem 27 and provides a seat for the upper ends of a pair of concentric valve springs 34 and 36. The lower ends of the springs 34 and 36 are received in an annular shallow cup 37 which surrounds the valve guide 28 and is supported on an annular surface 38 in the cylinder head 20.

A disc-shaped shim 39 of variable thickness for valve clearance adjustment is positioned in the retainer 33 and engages the underside of the end wall, indicated at 40, of an inverted, cup-shaped tappet 41. The tappet is slidably mounted in a guide 42, which is mounted in a bore 43 in the cylinder head 20, concentric with the valve guide bore 32. The upper surface, indicated at 44, of the tappet 41 is adapted to engage cam means, indicated generally at 46, and cam follower means, indicated generally at 47, for effecting opening of the valve 23 in timed relation with the speed of the engine. The cam means 46 and cam follower means 47 are part of a mechanism, indicated generally at 50, for varying the timing of the valve 23 with respect to the operating cycle of its associated cylinder in order to improve the power output and efficiency of the engine throughout its operating speed range, and to reduce the level of emissions from the engine.

Figure 2:
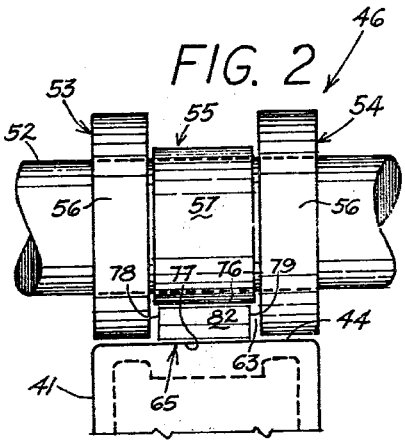
FIG. 2 is a fragmentary, side elevational view, taken substantially along the line 2—2 of FIG. 1, and showing one of the multi-lobed, conjugate cams of the mechanism.
Figure 3:
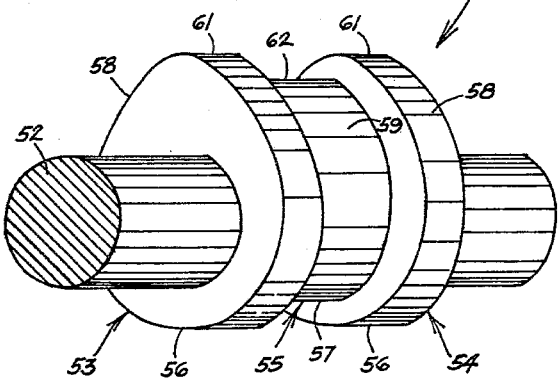
FIG. 3 is a fragmentary perspective view of the multi-lobed conjugate cam illustrated in FIG. 2.

Referring now to FIGS. 2 and 3 in conjunction with FIG. 1, it will be seen that the cam means 46 is carried on and rotatable with a cam shaft 52, which extends lengthwise of the cylinder head 20 and which has its axis of rotation in general perpendicular alignment with the axis of the stem 27 of the valve 23. It will be understood that a plurality of the cam means 46 are provided on the cam shaft 52, one for each intake valve of the engine, and another cam means (not shown), similar to the cam means 46, is provided for each exhaust valve of the engine.

Each cam means 46 is of the conjugate type in that it includes at least one and preferably a pair of axially spaced first radial cam members 53 and 54, and a second radial cam member 55, which is positioned between and is smaller than the cam members 53 and 54. The cam members 53, 54 and 55 have base circle and eccentric profile portions, the base circle portions of the cam members 53 and 54 being indicated at 56 in FIGS. 1 and 3 and the base circle portion of the cam member 55 being indicated at 57. The profile portions of the cam members 53 and 54 are likewise indicated at 58 and the profile portion of the cam member 55 is indicated at 59. The high points of the cam members 53 and 54 are indicated at 61 and the high point of the cam member 55 is indicated at 62.

As previously mentioned, the cam member 55 is smaller than the cam members 53 and 54. In other words, the radial dimensions of the base circle and profile portions 57 and 59 of the cam member 55 are less than those of the base circle and profile portions 56 and 58 of the cam members 53 and 54. Consequently, a radial clearance space, indicated at 63 in FIG. 2, is defined between the perimeter of the cam member 55 and the perimeters of the cam members 53 and 54.

The cam follower means of the mechanism 50 is in the form of an elongated member or finger 65, which coacts with the cam member 55 to cause the latter to exert a progressively greater control of the actuation of the valve 23 for different positions of engagement of the finger 65 with the cam member 55, as will be described more fully hereinafter. To this end, the finger 65 is shiftably mounted in the cylinder head 20 for reciprocating movement in a direction generally perpendicular to the axis of rotation of the cam shaft 52. To accommodate vertical displacements of the distal end, indicated at 66, of the finger 65, the proximal end thereof, indicated at 69, is pivotally connected to one end of an actuating shaft 67, the latter being supported in a bearing 68 mounted in an opening 72 in the cylinder head 20. The pivotal connection of the proximal end 69 of the finger to the inner end of the actuating shaft 67 thus permits relative rocking movement between the finger 65 and shaft 67 during movement of the valve 23.

Movement of the actuating shaft 67 in opposite axial directions may be effected either manually or automatically by some type of control mechanism (not shown) responsive to one or more operating conditions of the engine. Such conditions may, for example, comprise engine speed and manifold vacuum.

Figure 4:
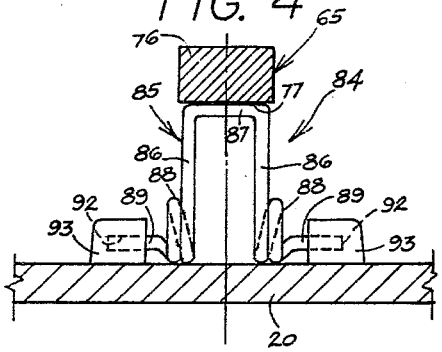
FIG. 4 is a vertical sectional view taken substantially along the line 4—4 of FIG. 1.

As best seen in FIGS. 1 and 4, the elongated member or finger 65 is rectangular in cross section and has substantially flat upper and lower surfaces 76 and 77, respectively, and flat side surfaces 78 and 79 (FIG. 2), respectively. Preferably, the finger 65 is tapered lengthwise so that the upper and lower surfaces 76 and 77 converge from the proximal end 69 thereof toward the distal end 66. However, it is contemplated that the taper of the upper and lower operating surfaces 76 and 77 could vary in other than a straight line relationship as is shown, for example, by the surface 77' of the finger 65 at the distal end 66 thereof. The taper is such that when the finger 65 is in a first or inoperative position illustrated in full lines in FIG. 1, the thickness of the finger is less than the radial dimensions of the clearance space 63. Consequently, only the cam members 53 and 54 control the action of the valve 23.

In order to reduce noise and battering when the finger 65 is in its full line, inoperative position illustrated in FIGS. 1 and 2, spring means, indicated generally at 84, is provided for biasing the finger into engagement with the cam member 55. The spring means 84, in the present instance, includes a U-shaped portion 85 (FIG. 4) having a pair of spaced arms 86 and a connecting portion 87 engaged with the undersurface 77 of the finger 65. The ends of the arms 86 may be formed with one or more turns 88 intermediate their length, and the remote ends, indicated at 89 in FIG. 4, of the arms 86 may be bent laterally outwardly so as to permit their insertion into retaining bores 92 in a pair of laterally spaced bosses 93 in the cylinder head 20. It will be understood that some other means could be used in place of the spring 84 to bias the finger 65 into engagement with the cam member 55, such as a torsion spring associated with the pivot end 69 of the finger 65. In some instances, it may be more desirable to bias the finger 65 into engagement with the tappet 41 instead of with the cam 55.

Referring now to FIGS. 5–12, inclusive, in conjunction with FIG. 1, the manner in which the cam means 46 and finger 65 of the mechanism 50 coact to vary the timing of the valve 23 for different operating conditions of the engine 15 will be described. The contours of the tappet 41 and finger 65 are somewhat diagrammatically shown in FIGS. 5–7 and 9–11, inclusive, for the purpose of illustrating the principles of operation of the invention and not to illustrate a working embodiment. Thus, assuming that the vehicle in which the engine 15 is installed is going to be operated at a low speed under a moderate to heavy load condition, the actuating shaft 67 will either manually or automatically be shifted to its first or full line position illustrated in FIG. 1. When so positioned, the portion of the finger 65 that extends into the clearance space 63 is of insufficient thickness to result in conjoint engagement between the upper and the lower surfaces 76 and 77 of the finger with the cam member 55 and upper surface 44 of the tappet 41, respectively, for all rotated positions of the cam means 46. This condition is illustrated in FIGS. 5–7, inclusive. Consequently, the timing, lift and duration of the valve 23, as well as the other valves of the engine 15 which are controlled by duplicates of the mechanism 50, will be controlled solely by the cam members 53 and 54. The contours of these cam members is such as to provide optimum engine performance and efficiency under the aforementioned low speed and moderate to heavy load conditions. By way of example, the contour of the cam members 53 and 54 may be such as to provide optimum power and efficiency of the engine up to about 3200 revolutions per minute.

Referring now to FIG. 8 in conjunction with FIGS. 5–7, inclusive, the timing providing by the cam members 53 and 54 for the intake valve 23 will now be described. Thus, as the piston associated with the valve 23 nears the end of its upward exhaust stroke, the valve begins to open. Opening of the intake valve 23 occurs when the piston is approximately 8 degrees before its top dead center position. Such position is indicated by the line 93 and by legend in FIG. 8, and by the point **93*a* on the cam member 54 in FIG. 5**.

As the piston reaches its top dead center position and then continues downwardly on its intake stroke, the valve 23 moves to its fully open position. The valve begins to close after the piston passes bottom dead center and is fully seated when the piston is moving upwardly on its compression stroke and has reached a position approximately 30 degrees after bottom dead center. Such position is indicated by the line 94 and by legend in FIG. 8, and by the point **94*a* on the cam member 54 in FIG. 7. The maximum lift of the valve 23 occurs when the high point 61 of the cam member 54 contacts the upper surface 44 of the tappet 41, as shown in FIG. 6**.

While not shown in the drawings, a cam means, similar to the cam means 46, is provided on the camshaft 52 for each exhaust valve of the engine 15 and a finger follower, similar to the finger 65, is also provided for coaction with a cam member of the exhaust valve cam means similar to the cam member 55. The exhaust valve cam means likewise includes at least one and preferably a plurality of cam members similar to the cam members 53 and 54. The cam means for the exhaust valves are arranged on the cam shaft 52 so that, when the engine is operating under a low speed and moderate to heavy load condition, each exhaust valve begins to open when its associated piston is moving downwardly on its power stroke and has reached a position approximately 35 degrees before bottom dead center. Such position is indicated by the line 96 in FIG. 8 and by legend.

Each exhaust valve remains open for the remainder of the power stroke of its associated piston and through the exhaust stroke thereof. The exhaust valves are fully closed after their respective pistons have passed their top dead center positions and reached a position approximately 4 degrees after their top dead center positions. The fully closed position of the exhaust valves is indicated by the line 97 in FIG. 8 and by legend.

Assuming now that the vehicle in which the engine 15 is installed is no longer operating under a low speed and moderate to heavy load condition but is accelerating to a cruising condition at high revolutions per minute of the engine. During the transition from the former to the latter condition, the finger 65 will shift inwardly from its full line position illustrated in FIG. 1 and its position shown in FIGS. 5–7, inclusive, to a second position wherein the upper and lower surfaces 76 and 77 of the finger 65 conjointly engage the cam member 55 and upper surface 44 of the tappet 41 for at least a portion of each revolution of the cam shaft 52. Consequently, at this time, the timing of the valve 23 is controlled primarily by the cam members 53 and 54 and only partially by the cam member 55.

Depending upon the conditions deriving from a combination of factors including rotational speed of the engine and the demands upon it, the finger 65 may not move inwardly toward the cam shaft 52 much beyond its aforementioned second position. However, for the purposes of the description of the invention, it will be assumed that the operating conditions are such as to cause the finger to move fully inwardly toward the cam shaft 52 to a third position, shown in broken lines in FIG. 1 and indicated at 65', where the finger completely fills the radial clearance space 63. When so positioned, the timing of the valve 23 is controlled only by the cam member 55, the contour of which is such as to provide optimum power and efficiency of the engine in the upper speed range thereof. For example, the cam member 55 may be such as to cause the power and efficiency of the engine to increase up to about 6400 revolutions per minute. The change in the timing of the valve 23 when the finger is in its broken line position 65' and the cam member 55 is in sole control of the actuation of the valve 55, will now be described.

Referring initially to FIG. 9 in conjunction with FIG. 12, it will be seen that when the finger 65 is shifted fully into the clearance space 63, conjoint engagement of the upper and lower surfaces 76 and 77 of the finger 65 with the start of the ramp or profile portion 59 of the cam member 55 and the upper surface 44 of the tappet 41 will occur sooner (by approximately 10 degrees of crankshaft rotation) than when the ramp portion 58 of the cam members 53 and 54 engage the upper surface 44 of the tappet and begin to lift the valve 23. The point at which the ramp portion 59 of the cam member 55 starts to open the valve 23 is indicated by the line 102 in FIG. 12 and by legend. Such point is also indicated at **102*a* in FIG. 9**.

The valve 23 reaches its maximum lift when the high point 62 of the cam member 55 contacts the upper surface 76 of the finger 65, as shown in FIG. 10. Such lift is at least as great as that provided by the cam members 53 and 54 when their high points 61 are engaged with the upper surface 76 of the finger.

The intake valve 23 remains open for the full intake stroke of its associated piston and also for a portion of the compression stroke thereof. As shown in the timing diagram in FIG. 12, the intake valve 23 does not close until its associated piston has moved to a position approximately 55 degrees after bottom dead center. this point is indicated by the line 104 in FIG. 12 and by legend. Such point is also indicated by the point **104*a* on the cam member 55 in FIG. 11**.

As previously mentioned, the cam means for each exhaust valve of the engine likewise includes a cam member, similar to the cam member 55 for the intake valve 23, to effect a similar change in the timing of each exhaust valve of the engine when the vehicle is operating, for example, at a cruising condition at high revolutions per minute of the engine. Thus, when the finger followers associated with the cam members for the exhaust valves extend fully into the radial clearance space between their counterparts to the cam members 53, 54 and 55 of the cam means 46, the exhaust valves for each cylinder of the engine will begin to open when their respective pistons have reached a position approximately 50 degrees before their bottom dead center positions as the pistons are moving downwardly on their power strokes. Such position is indicated by the line 107 in the timing diagram in FIG. 12 and by legend.

The exhaust valves move to their fully open positions and remain open for the remainder of the power strokes of their respective pistons when the engine is operating under a high speed cruise condition and continue to remain open through the exhaust strokes of the pistons and also through a portion of the intake strokes. As shown in FIG. 12, the exhaust valves are fully closed when their respective pistons reach a position approximately 20 degrees after top dead center. Such position is indicated by the line 108 in FIG. 12 and by legend.

It will be understood that sufficient clearance is provided between the base circle portions 56 of the cam members 53 and 54 and the upper surface 44 of the tappet 41, and likewise between the base circle portion 57 of the cam member 55 and the lower surface 77 of the finger 65 and the upper surface 44 of the tappet, to assure seating of the valve 23. Similar clearances would also be provided to assure seating of the exhaust valves of the engine.

From the foregoing it will now be apparent that the mechanism 50 of the present invention is capable of providing a substantial change in the timing of the opening and closing of the intake valves and moreover, as is preferable, of both the intake and exhaust valves of an internal combustion engine in accordance with changing operating conditions so that the performance and efficiency of the engine is substantially increased over a conventional engine wherein only one cam is utilized for controlling the timing of each intake and each exhaust valve. Moreover, because the mechanism 50 is capable of varying the timing of the valves of an engine during transition speed and load conditions, optimum performance and efficiency is obtained for many or substantially all operating speeds and load conditions of the engine. The mechanism 50 also effectively reduces undesirable emissions from the engine.

Referring now to FIG. 13, a portion of another internal combustion engine is illustrated and indicated generally at 110. The engine 110 incorporates a variable valve timing mechanism, indicated generally at 111, embodying the features of the present invention and employing parts the same as or similar to those of the variable valve timing mechanism 50. Consequently, like reference numerals have been used to identify identical parts.

The engine 110 is conventional to the extent that it includes a cylinder head 120 having at least one intake and one exhaust passage for each cylinder, and at least one intake and one exhaust valve for controlling fluid flow through the intake and exhaust passages. Only one intake passage, indicated at 122, and one intake valve, indicated at 123, are shown in FIG. 13, however.

The valve 123 has a head 124, which engages a seat 126 at the inner end of the passage 122, and an elongated stem 127. The stem 127 is shiftably mounted in a guide 128, which is mounted in a bore 132 in the cylinder head 120. A spring retainer 133 is secured to the upper end of the valve stem 127 for retaining the upper end of a valve spring 134. The lower end of the valve spring 134 is received and retained in an annular cup 137 which surrounds the valve guide 128.

Downward movement of the stem 127 of the valve 123 to open the valve and permit fluid flow through the intake passage 122 is achieved by linkage means, indicated generally at 140, which interconnects the cam means, indicated generally at 46, of the mechanism 111 with the valve 123 to effect opening of the valve in timed relation with the speed of the engine.

The linkage means 140, in the present instance, comprises a rocker arm 143 which is rockably mounted on a shaft 144 extending longitudinally through the cylinder head 120. One end, indicated at 146, of the rocker arm 143 engages the cam means 46 and the opposite end, indicated at 147, is provided with a roller 148 for engaging the upper end, indicated at 149, of the valve stem 127.

The mechanism 111 is similar to the mechanism 50 in that it also includes cam follower means, indicated generally at 152, which coacts with the cam means 46 to vary the timing of the valve 123 in order to improve the power output and efficiency of the engine 110. The cam follower means 152 of the mechanism 111 is in the form of an elongated member or finger 155 having lower and upper surfaces, indicated at 156 and 157, respectively, which are preferably flat and which converge from the proximal end, indicated at 159, of the finger toward the distal end, indicated at 162 thereof.

The mechanism 111 differs from the mechanism 50 in that the upper surface 157 of the finger 155 engages the end 146 of the rocker arm 143 instead of directly engaging a tappet for engaging the upper end 149 of the valve 123.

The finger 155 is shiftable toward and away from the cam shaft 52 in order to control the period of engagement of the finger 155 with the cam member 55 and end 146 of the rocker 143 to vary the timing of the valve 123 for different operating conditions of the engine. To this end, the proximal end 159 of the finger is pivotally connected to the inner end of an actuating shaft 166, which is slidably mounted in a bearing 167 in the cylinder head 120. Movement of the actuating shaft 166 in opposite directions to vary the timing of the valve 123 may be effected either manually or automatically by some type of control mechanism responsive to different operating conditions of the engine. Such conditions may, for example, comprise engine speed and manifold vacuum.

As in the previous embodiment, spring means, indicated generally at 170 is provided for biasing the finger 155 into engagement with the cam member 55 to reduce noise and battering. However, since the cam member 55 is positioned below the finger 155 in the engine 110, the spring means 170 biases the finger downwardly so that the lower surface 156 of the finger 155 engages the cam member 55. In some instances, it may be more desirable to bias the finger 155 into engagement with the end 146 of the rocker 143 instead of with the cam 55. The spring means 170 is generally of the same construction as the spring means 84 of the previous embodiment in that it includes a generally U-shaped or bail portion 172 having spaced arms 173 and a connecting portion 174 which engages the upper surface 157 of the finger 155. The ends of the arms 172 may include one or more turns 176, and the remote ends, indicated at 177, of the arms 172 may be bent laterally outwardly so as to permit insertion into bores 178 in retaining bosses 179 at the upper end of the cylinder head 120. As in the previous embodiment, some other means could be used to bias the finger 155 into engagement with the cam member 55 or the end 146 of the rocker 143.

The mechanism 111 functions in the same manner as the mechanism 50 of the previous embodiment. Accordingly, reference should be made in this specification to the description of the operation of the mechanism 50 and the coaction of the finger 47 with the cam means 46 for an understanding of the operation of the mechanism 111 and the manner in which the finger 155 coacts with the cam means 46 of the engine 110 to vary the timing of the valve 123.

While only two embodiments of the invention have been herein illustrated and described, it will be understood that modifications and variations thereof may be effected without departing from the spirit of the invention. Thus, while the cam means 46 has been herein described as including three conjugate radial cam members 53, 54 and 55, the cam means 46 could also be constructed with only two cam members, such as the cam members 54 and 55. In such a construction, the axial positions of the cam members 54 and 55 would be somewhat different from the positions thereof shown in FIG. 2 in order to avoid excessive asymmetric loading of the tappet 41.

In addition, while the cam means 46 has been herein described with the central cam member 55 being of smaller size than the adjacent cam members 53 and 54, this size relationship could be reversed, i.e. the cam members 53 and 54 could be smaller than the central cam member 55. In such a construction, the finger 65 of the cam follower means 47 could be bifurcated so as to straddle the larger central cam member and engage the smaller adjacent cam members.

It should also be understood that while the variable valve timing mechanisms 50 and 111 of the present invention have been herein described in automotive engine applications, such mechanisms could also be used to advantage in stationary internal combustion engines, which must be operated under varying speed and load conditions.

I claim:

1. Mechanism for varying the time at which a valve for controlling fluid flow into or out of a combustion chamber of an internal combustion engine opens and closes, said combustion chamber being defined by a cylinder in the engine and piston means movable in the cylinder for varying the volume thereof, said engine also including a rotatable camshaft driven in timed relation with the speed of the engine and linkage means for transmitting reciprocating movement to said valve, said mechanism comprising cam means on said camshaft and including a first cam member adapted to engage said linkage means and contoured to provide a first timing for said valve such as will provide optimum performance and efficiency of the engine throughout one operating speed range and a second cam member contoured to provide a second timing for said valve such as will provide optimum performance and efficiency of the engine throughout another operating speed range, and follower means including an elongated member engageable with said second cam member and said linkage means for rendering said second cam member operable to at least partially control the timing of said valve, said elongated member being shiftable to a first position wherein said elongated member does not conjointly engage said second cam member and said linkage means so that the timing of said valve is controlled only by said first cam member, and said elongated member being shiftable to a second position wherein said elongated member conjointly engages said second cam member and said linkage means so that the timing of said valve is at least partially controlled by said second cam member.

2. The mechanism of claim 1, in which said elongated member is shiftable in a direction generally perpendicular to the axis of rotation of said camshaft.

3. The mechanism of claim 1, in which said elongated member is shiftable to a third position wherein the timing of said valve is controlled only by said second cam member.

4. The mechanism of claim 3, in which said elongated member is shiftable throughout a range of positions between said second and third positions, the timing of said valve being controlled in part by said first cam member and in part by said second cam member throughout said range.

5. The mechanism of claim 4, in which said elongated member has a first surface engageable with said second cam member and a second surface engageable with said linkage means, and said first and second surfaces are substantially flat.

6. The mechanism of claim 5, in which said elongated member is tapered so that said first and second surfaces are inclined with respect to each other.

7. The mechanism of claim 6, in which said elongated member has distal and proximal ends and tapers from the proximal toward the distal end thereof.

8. The mechanism of claim 7, in which at least one of said first and second surfaces has a contour such that at least a portion of the taper of said elongated member is other than a straight line relationship.

9. The mechanism of claim 4, in which said linkage means includes a tappet, the second surface of said elongated member is engageable with said tappet, and said tappet has a surface contoured to smoothly engage said second surface of said elongated member throughout the range of movement thereof between said second and third positions.

10. The mechanism of claim 1, in which spring means is provided for biasing said elongated member toward said second cam member to maintain contact therebetween and prevent noise or battering when said elongated member is in said first position.

11. The mechanism of claim 1, in which an axially spaced pair of said first cam members are provided on said camshaft, said pair of first cam members being respectively arranged on opposite sides of said second cam member and adapted to conjointly engage said linkage means.

12. The mechanism of claim 11, in which said second cam member is smaller than said pair of first cam members so that a clearance space is defined between the perimeters of said second cam member and the perimeters of said pair of first cam members, and said elongated member extends into said clearance space.

13. The mechanism of claim 12, in which said pair of first cam members confine said elongated member in said clearance space.

14. The mechanism of claim 13, in which said elongated member is generally rectangular in cross section.

* * * * *